US006961026B2

(12) United States Patent
Toda

(10) Patent No.: US 6,961,026 B2
(45) Date of Patent: Nov. 1, 2005

(54) ADAPTIVE ANTENNA UNIT AND TERMINAL EQUIPMENT

(75) Inventor: Takeshi Toda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 123 days.

(21) Appl. No.: 10/454,767

(22) Filed: Jun. 4, 2003

(65) Prior Publication Data

US 2004/0036651 A1 Feb. 26, 2004

(30) Foreign Application Priority Data

Jun. 5, 2002 (JP) ..... 2002-164111
May 29, 2003 (JP) ..... 2003-153182

(51) Int. Cl.[7] ..... H01Q 21/00
(52) U.S. Cl. ..... 343/817; 343/833
(58) Field of Search ..... 343/817, 818, 343/833, 834, 835, 893

(56) References Cited

U.S. PATENT DOCUMENTS 6,369,770 B1 4/2002 Gothard et al.
6,492,942 B1 * 12/2002 Kezys ..... 342/368
6,788,268 B2 * 9/2004 Chiang et al. ..... 343/850

FOREIGN PATENT DOCUMENTS

| | | |
|---|---|---|
| EP | 1 014 485 | 6/2000 |
| EP | 1 124 281 A2 | 8/2001 |
| JP | 2002-16432 | 1/2002 |
| WO | 00/03456 | 1/2000 |
| WO | WO 01/35490 A1 | 5/2001 |

OTHER PUBLICATIONS

European Search Report dated Sep. 10, 2004.
Dinger, "Reactivity steered adaptive array using microstrip patch at 4 GHZ", IEEE Trans. Antennas & Propag., vol. AP–32 No. 8, pp. 848–856, Aug. 1984.
Dinger, et al., "A Compact HF Antenna Array Using Reactively–Terminated Parasitic Elements for Pattern Control" Naval Research Laboratory Memorandum Report 4797, May 1992 pp. 1–32.
Dinger, "A Planar Version of A 4.0 GHZ Reactively Steered Adaptive Array" IEEE Trans. Antennas & Propag., vol. AP–34, No. 3 pp. 427–431, Mar. 1986.
Harrington, "Ractively Controlled Directive Arrays"IEEE Trans. Antennas & Propag., vol. AP–26, No. 3, pp. 390–395, May 1978.

* cited by examiner

*Primary Examiner*—Shih-Chao Chen
(74) *Attorney, Agent, or Firm*—Katten Muchin Zavis Rosenman

(57) ABSTRACT

An adaptive antenna unit includes feeding antenna elements arranged so as to reduce spatial correlations thereof, parasitic antenna elements, provided with respect to each of the feeding antenna elements and arranged so as to increase mutual coupling between a corresponding one of the feeding antenna elements, variable reactance elements each terminating a corresponding one of the parasitic antenna elements, and a control section. The control section controls reactances of the reactance elements and controls weighting of the reception signals received by the feeding antenna elements, in response to the reception signals.

18 Claims, 8 Drawing Sheets

ADAPTIVE ANTENNA UNIT AND TERMINAL EQUIPMENT

BACKGROUND OF THE INVENTION

This application claims the benefit of a Japanese Patent Applications No.2002-164111 filed Jun. 5, 2002 and No.2003-153182 filed May 29, 2003, in the Japanese Patent Office, the disclosure of which is hereby incorporated by reference.

1. Field of the Invention

The present invention generally relates to adaptive antenna units, and more particularly to an adaptive antenna unit which adaptively controls transmission and reception characteristics by arranging a plurality of antenna element pairs each made up of a feeding antenna element and a plurality of parasitic antenna elements, and an adaptive antenna unit which adaptively controls transmission and reception characteristics by arranging a plurality of array antenna sections each formed by a plurality of feeding antenna elements. The present invention also relates to a terminal equipment which is provided with such an adaptive antenna unit.

2. Description of the Related Art

Various kinds of adaptive antenna units having a plurality of antenna elements have been proposed. For example, a diversity antenna unit, having a plurality of antenna elements arranged so as to reduce respective spatial correlations, is known.

FIG. 1 is a diagram showing an example of such a conventional diversity antenna unit. The diversity antenna unit shown in FIG. 1 includes a plurality of antenna elements 31, a plurality of transmitter-receiver radio frequency front ends (RFF/Es), a plurality of transmitter-receivers (T/Rs) 33, and a digital signal processing circuit 34. The digital signal processing circuit 34 includes a weighting control circuit 35, a plurality of weighting circuits 36, and a combining (Σ) circuit 37.

The antenna elements 31 are arranged at a pitch d satisfying a relationship $d>\lambda$, where λ denotes the wavelength. In other words, the antenna elements 31 are arranged so as to reduce the spatial correlations thereof. One RFF/E 32 and one transmitter-receiver 33 are provided with respect to each antenna element 31. A reception signal received by the antenna element 31 is weighted by the corresponding weighting circuit 36 via the RFF/E 32 and the transmitter-receiver 33. The weighting circuit 36 corresponding to each antenna element 31 is controlled by the weighting control circuit 35, so as to maximize a signal-to-interference-plus-noise ratio (SINR) of an output signal of the combining circuit 37. The output signal of the combining circuit 37 is obtained by combining the weighted reception signals obtained via the weighting circuits 36.

FIG. 2 is a diagram for explaining a transmitter-receiver circuit corresponding to one antenna element 31. The transmitter-receiver circuit shown in FIG. 2 includes one RFF/E 32 and one transmitter-receiver (T/R) 33 respectively corresponding to one antenna element 31 shown in FIG. 1, and the digital signal processing circuit 34 which is formed by a digital signal processor (DSP).

The RFF/E 32 includes a transmitter-receiver shared unit 40, bandpass filters (BPFs) 41, 43 and 46, low-noise amplifiers (LNA) 42 and 44, and a power amplifier (PA) 45. The transmitter-receiver share unit 40 includes a switch and a filter to enable sharing of the antenna element 31 for the transmission and the reception.

The transmitter-receiver 33 includes a mixer 47, a bandpass filter (BPF) 48, demodulators 49 and 50, lowpass filters (LPFs) 51 and 52, analog-to-digital converters (ADCs) 53 and 54, digital-to-analog converters (DACs) 55 and 56, lowpass filters (LPFs) 57 and 58, modulators 59 and 60, a combining (+) circuit 61, and local oscillators LO1 through LO3.

The RFF/E 32 eliminates by the BPF 41 an unwanted band component of the reception signal received by the antenna element 31 and obtained via the transmitter-receiver shared unit 40. An output of the BPF 41 is amplified by the LNA 42 and input to the transmitter-receiver 33 via the BPF 43. In addition, the RFF/E 32 amplifies by the LNA 44 the transmission signal received from the transmitter-receiver 33. An output of the LNA 44 is amplified by the PA 45 to a desired transmission power. An output of the PA 45 is input to the BPF 46 which eliminates an unwanted band component, and an output of the BPF 46 is input to the antenna element 31 via the transmitter-receiver shared unit 40 and is transmitted from the antenna element 31.

In the transmitter-receiver 33, the mixer 47 mixes the output of the BPF 43 and a local oscillation signal from the local oscillator LO1 to output an intermediate frequency (IF) signal. The BPF 48 eliminates an unwanted band component of the IF signal received from the mixer 47. The demodulators 49 and 50 have structures similar to the mixer 47. Hence, an output of the BPF 48 is mixed with 90-degree phase local oscillation signals from the local oscillator LO2 in the respective demodulators 49 and 50. Outputs of the demodulators 49 and 50 are input to the corresponding LPFs 51 and 52 wherein unwanted high-frequency components are eliminated. Outputs of the LPFs 51 and 52 are converted into digital signals by the corresponding ADCs 53 and 54. The digital signals output from the ADCs 53 and 54 are finally input to the digital signal processing circuit 34, so as to form a reception path.

On the other hand, digital signals output from the digital signal processing circuit 34 are converted into analog signals in the corresponding DACs 55 and 56, and input to the corresponding LPFs 57 and 58 wherein unwanted high-frequency components are eliminated. Outputs of the LPFs 57 and 58 are input to the corresponding modulators 59 and 60 and modulated by 90-degree phase local oscillation signals from the local oscillator LO3. Outputs of the modulators 59 and 60 are combined in the combining circuit 61 and finally input to the RFF/E 32, so as to form a transmission path.

The antenna elements 31 shown in FIG. 1 may be arranged at a pitch d satisfying a relationship $d<\lambda$, where λ denotes the wavelength, so as to increase the spatial correlations thereof. In this case, an adaptive antenna unit, which is often referred to as an array antenna unit, is formed. The structures of the RFF/Es 32 and the transmitter-receivers 33 for the adaptive antenna unit are the same as those shown in FIGS. 1 and 2.

In the case of the diversity antenna unit having the antenna elements 31 arranged so as to reduce the spatial correlations, a grating lobe is generated by the spreading of the pitch of the antenna elements 31. For this reason, there are problems in that the gain in a desired direction decreases, and that radio wave is also radiated in a direction other than the desired direction at the time of the transmission.

On the other hand, in the case of the array antenna unit having the antenna elements 31 arranged so as to increase the spatial correlations thereof, the gain in the desired direction improves because no grating lobe is generated.

However, since the pitch of the antenna elements 31 is narrow, it is difficult to compensate for the fading and to separate a desired wave and an interference wave with adjacent arrival directions.

Accordingly, a structure which combines diversity branches and array branches, as shown in FIG. 3, has been proposed. In FIG. 3, those parts which are the same as those corresponding parts in FIGS. 1 and 2 are designated by the same reference numerals.

The antenna unit shown in FIG. 3 includes a plurality of array branches a1 through an, and a signal processing circuit 34, An array branch ai includes a plurality of antenna elements 31-*i*, a plurality of RFF/Es 32-*i*, and a plurality of transmitter-receivers (T/Rs) 33-*i*, where i is an integer satisfying i=1 to n. The digital signal processing circuit 34 includes a weighting control circuit 35, a plurality of weighting circuits 36-1 through 36-*n*, and a combining (Σ) circuit 37.

In each array branch ai, the antenna elements 31-*i* are arranged at a pitch d1 satisfying a relationship d1<λ, where λ denotes the wavelength. In addition, the array branches a1 through an are arranged at a pitch d2 satisfying a relationship d2>λ, where λ denotes the wavelength, so as to form a diversity branch structure.

In the digital signal processing circuit 34, the weighting control circuit 35 controls the weighting of each of the weighting circuits 36-1 through 36-*n* respectively corresponding to the antenna elements 31-1 through 31-*n* of the corresponding array branches a1 through an, so that the SINR of an output of the combining circuit 37 becomes a maximum.

The fading compensation and the like are carried out by the diversity combining process, and the separation of the desired wave and the interference wave with adjacent arrival directions is carried out by the diversity branches. In a case where a high-gain directivity is to be obtained in the desired direction, it is possible to cope with various states by applying an adaptive control by the array branches a1 through an, as proposed in an International Publication Number WO00/03456 A1, for example.

According to the structure shown in FIG. 3, for example, one RFF/E 32-*i*, one transmitter-receiver 33-*i*, and one weighting circuit 36-*i* are required with respect to each antenna element 31-*i*, where i=1 to n. In addition, each transmitter-receiver 33-*i* includes demodulators, modulators, ADCs, DACs and the like as shown in FIG. 4. For this reason, when the number of antenna elements is increased in order to improve the transmission and reception characteristics, there were problems in that the antenna unit as a whole becomes bulky, and that the power consumption of the antenna unit increases considerably. Consequently, such a bulky and power-consuming antenna unit was unsuited for mobile terminals which are used for mobile communications.

SUMMARY OF THE INVENTION

Accordingly, it is a general object of the present invention to provide a novel and useful adaptive antenna unit and terminal equipment in which the problems described above are eliminated.

Another and more specific object of the present invention is to provide an adaptive antenna unit which improves the transmission and reception characteristics by combining an array branch structure and a diversity branch structure, and also enables the size and power consumption to be reduced, and to provide a terminal equipment provided with such an adaptive antenna unit.

Still another object of the present invention is to provide an adaptive antenna unit comprising a plurality of feeding antenna elements arranged so as to reduce spatial correlations thereof; a plurality of parasitic antenna elements, provided with respect to each of the plurality of feeding antenna elements, and arranged so as to increase mutual coupling between a corresponding one of the plurality of feeding antenna elements; a plurality of variable reactance elements, each terminating a corresponding one of the plurality of parasitic antenna elements; and a control section controlling reactances of the plurality of reactance elements and controlling weighting of the reception signals received by the plurality of feeding antenna elements, in response to the reception signals. According to the adaptive antenna unit of the present invention, it is possible to carry out compensation of the fading by the diversity branches formed by the feeding antenna elements. In addition, it is possible to suppress interference by forming array branches each formed by one feeding antenna element and the corresponding parasitic antenna elements. The adaptive antenna unit also has reduced size and power consumption due to the relatively simple structure.

A further object of the present invention is to provide a terminal equipment comprising an adaptive antenna unit; and transmitting and receiving means for making a communication via the adaptive antenna unit, wherein the adaptive antenna unit comprises a plurality of feeding antenna elements arranged so as to reduce spatial correlations thereof; a plurality of parasitic antenna elements, provided with respect to each of the plurality of feeding antenna elements, and arranged so as to increase mutual coupling between a corresponding one of the plurality of feeding antenna elements; a plurality of variable reactance elements, each terminating a corresponding one of the plurality of parasitic antenna elements; and a control section controlling reactances of the plurality of reactance elements and controlling weighting of the reception signals received by the plurality of feeding antenna elements, in response to the reception signals. According to the terminal equipment of the present invention, it is possible to carry out compensation of the fading by the diversity branches formed by the feeding antenna elements. In addition, it is possible to suppress interferences by forming array branches each formed by one feeding antenna element and the corresponding parasitic antenna elements. Since the adaptive antenna unit has reduced size and power consumption due to the relatively simple structure, the terminal equipment may not only be a base station of a mobile communication system but also terminals such as a mobile telephone set and a data communication terminal.

Another object of the present invention is to provide an adaptive antenna unit comprising a plurality of array antenna sections provided at a pitch greater than a predetermined distance; a weighting control section weighting and combining output signals of the plurality of array antenna sections; and a controller generating control signals based on the output signals of the plurality of array antenna sections, wherein each of the plurality of array antenna sections comprises a plurality of antenna elements arranged at a pitch smaller than the predetermined distance; a phase shift part to adjust relative phases of reception signals received by the plurality of antenna elements in response to the control signals; and a combining circuit to combine the reception signals obtained via the phase shift section and outputting the output signal. According to the adaptive antenna unit of the present invention, it is possible to carry out compensation of the fading by the diversity branches formed by the feeding antenna elements. In addition, it is possible to suppress interference by forming array branches each formed by one feeding antenna element and the corresponding parasitic antenna elements. The adaptive antenna unit also has reduced size and power consumption due to the relatively simple structure.

Still another object of the present invention is to provide a terminal equipment comprising an adaptive antenna unit; and transmitting and receiving means for making a communication via the adaptive antenna unit, where the adaptive antenna unit comprises a plurality of array antenna sections provided at a pitch greater than a predetermined distance; a weighting control section weighting and combining output signals of the plurality of array antenna sections; and a controller generating control signals based on the output signals of the plurality of array antenna sections, wherein each of the plurality of array antenna sections comprises a plurality of antenna elements arranged at a pitch smaller than the predetermined distance; a phase shift part to adjust relative phases of reception signals received by the plurality of antenna elements in response to the control signals; and a combining circuit to combine the reception signals obtained via the phase shift section and outputting the output signal. According to the terminal equipment of the present invention, it is possible to carry out compensation of the fading by the diversity branches formed by the feeding antenna elements. In addition, it is possible to suppress interferences by forming array branches each formed by one feeding antenna element and the corresponding parasitic antenna elements. Since the adaptive antenna unit has reduced size and power consumption due to the relatively simple structure, the terminal equipment may not only be a base station of a mobile communication system but also terminals such as a mobile telephone set and a data communication terminal.

Other objects and further features of the present invention will be apparent from the following detailed description when read in conjunction with the accompanying drawings.

DESCRIPTION OF THE PREFERRED EMBODIMENTS

Figure 4:
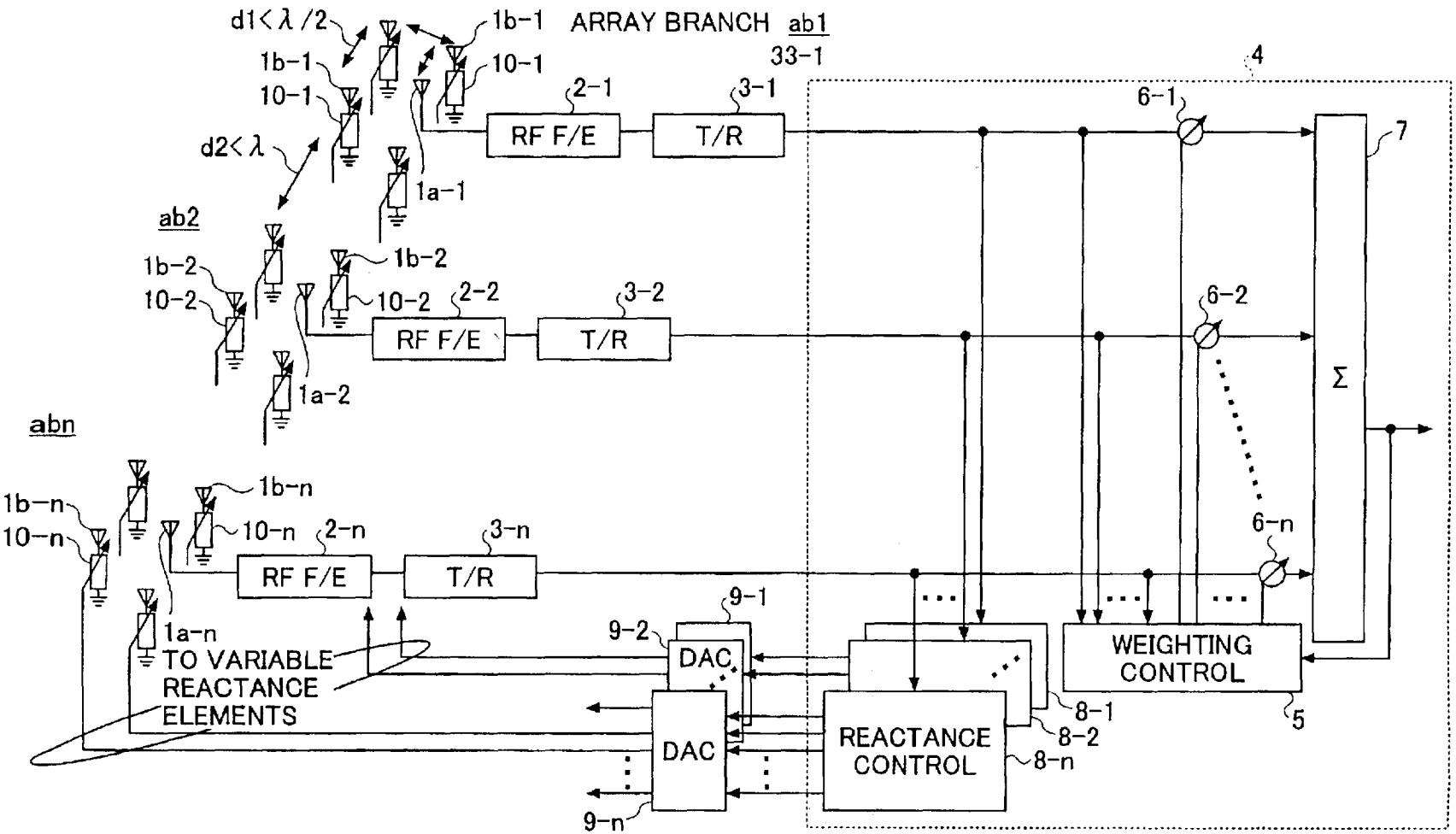
FIG. 4 is a diagram showing an embodiment of an adaptive antenna unit according to the present invention.

FIG. 4 is a diagram showing an embodiment of an adaptive antenna unit according to the present invention. The adaptive antenna unit shown in FIG. 4 includes a plurality of array branches ab1 through 1*bn,* a digital signal processing circuit 4, and digital-to-analog converters (DACs) 9-1 through 9-*n*.

Each array branch abi includes a feeding antenna element 1*a-i,* a plurality of parasitic antenna elements 1*b-i,* a plurality of variable reactance elements 10-*i,* a plurality of radio frequency front ends (RFF/Es) 2-*i,* and a plurality of transmitter-receivers (T/Rs) 3-*i,* where i is an integer satisfying i=1 to n. In the following description, it is assumed that i is an integer satisfying i=1 to n.

With respect to each feeding antenna element 1*a-i,* the plurality of parasitic antenna elements 1*b-i* are arranged at a pitch d1 satisfying a relationship $d1<\lambda/2$, where $\lambda$ denotes the wavelength. In addition, the array branches ab1 through 1*bn* are arranged at a pitch d2 satisfying a relationship $d2>\lambda$, where $\lambda$ denotes the wavelength. In other words, the plurality of parasitic antenna elements 1*b-i* are arranged at the pitch d1 within each array branch abi so as to increase the mutual coupling (or interconnection) with respect to the feeding antenna element 1*a-i*, and further, the array branches ab1 through abn are arranged at the pitch d2 so as to reduce the spatial correlations.

In each array branch abi, each of the parasitic antenna elements 1*b-i* is terminated by the variable reactance element 10-*i*.

The digital signal processing circuit 4 includes a weighting control circuit 5, a plurality of weighting circuits 6-1 through 6-*n*, a combining (Σ) circuit 7, and a plurality of reactance control circuits 8-1 through 8-*n*.

The reactance control circuit 8-*i* controls the variable reactance elements 10-*i* of the corresponding array branch abi based on a reception signal received by the feeding antenna element 1*a-i* of this array branch abi, so as to maximize a signal-to-interference ratio (STR) of the reception signal received by the feeding antenna element 1*a-i*.

By controlling the variable reactance elements 10-*i* which terminate the parasitic antenna elements 1*b*-1 which are arranged at the pitch $d1<\lambda/2$ with respect to the feeding antenna element 1*a-i* of the array branch abi, it is possible to utilize the feeding antenna element 1*a-i* as a radiator, a portion of the parasitic antenna elements 1*b-i* as a reflector, and a remaining portion of the parasitic antenna elements 1*b-i* as a director, thereby enabling control of the directivity of the array branch 1*bi*. By controlling the variable reactance elements 10-1 through 1-*n* of the array branches ab1 through 1*bn* in this manner, it is possible to make the directivities of all of the array branches ab1 through 1*bn* the same, so as to improve the gain as a whole and to carry out control such as compensation of the fading.

The DACs 9-1 through 9-*n* are provided to enable control of the variable reactance elements 10-1 through 10-*n* by analog signals. Hence, in a case where the variable reactance elements 10-1 through 10-*n* can be controlled by digital signals, it is possible to omit the DACs 9-1 through 9-*n*.

For example, each of the variable reactance elements 10-1 through 10-*n* may be formed by a plurality of fixed reactance elements having fixed reactances, and a switch which is controlled by a control signal to realize a reactance value by one fixed reactance element or a combination of two or more reactance elements. The control signal for controlling the switch of each variable reactance element 10-*i* may be obtained from the DAC 9-*i*. Of course, the DAC 9-*i* may be omitted if the switch of each variable reactance element 10-*i* may be controlled directly by the digital output of the reactance control circuit 8-*i*.

In the digital signal processing circuit 4, the weighting control circuit 5 controls the weighting of each of the weighting circuits 6-1 through **6-*n* respectively corresponding to the feeding antenna elements 1*a*-1 through 1*a*-*n* of the corresponding array branches ab1 through abn, so as to maximize the signal-to-interference-plus-noise ratio (SINR) of an output of the combining circuit 7. The weighting circuits 6-1 through 6-*n* may be formed by multipliers. Since the weighting control circuit 5, the weighting circuits 6-1 through 6-*n*, the combining circuit 7, and the reactance control circuits 8-1 through 8-*n* process digital signals, the functions of the digital signal processing circuit 4** may be realized by operation functions of a digital signal processor (DSP).

A structure in which a plurality of parasitic antenna elements each terminated by a variable reactance element are arranged with respect to a single feeding antenna element is sometimes referred to as an electronically steerable passive array radiator (ESPAR). For example, the ESPAR itself is discussed in R. F. Harrington, "Reactively Controlled Directive Arrays", IEEE Trans. Ant. and Prop. Vol.AP-26, No.3, May 1978, R, J. Dinger, "A Plannar Version of a 40 GHz Reactively Steared Adaptive Array", IEEE Trans. Ant. and Prop. Vol.AP-34, No.3, March 1986, R. J. Dinger and W. D. Meyers, "A compact HF antenna array using reactively-terminated parasitic elements for pattern control", Naval Research Laboratory Memorandum Report 4797, May 1992, R. J. Dinger, "Reactively steered adaptive array using microstrip patch at 4 GHz", IEEE Trans. Antennas & Propag., vol.AP-32, No.8, pp.848–856, August 1984, and Japanese Laid-Open Patent Application No. 2002-16432.

The structure of this embodiment, however, is different from that of the ESPAR. First, this embodiment has a plurality of feeding antenna elements **1*a*-1 through 1*a*-*n*. Second, a plurality of array branches ab1 through abn including the corresponding feeding antenna elements 1*a*-1 through 1*a*-*n* are arranged at a pitch d2 satisfying the relationship d2>λ, where λ denotes the wavelength. Third, each of a plurality of parasitic antenna elements 1*b*-*i* within each array branch abi is terminated by a variable reactance element 10-*i* which is controlled by a corresponding reactance control circuit 8-*i*.**

The structure of each of the variable reactance elements 10-1 through **10-*n* is not limited to a particular structure as long as the reactance is variable. For example, a varactor diode having a capacitance varied in response to a voltage applied thereto may be used as the variable reactance elements 10-1 through 10-*n*. In this case, it is desirable that the varactor diode has a linear characteristic with respect to the control signal which is received from each of the reactance control circuits 8-1 through 8-*n* via the corresponding DACs 9-1 through 9-*n*.** In order to realize the linear characteristic, the varactor diode may be formed by a combination of a variable capacitor having a micro electro mechanical system (MEMS) structure, an inductance and a switch.

The variable capacitor may be of a type which varies the capacitance by modifying a pair of opposing electrodes which are formed by micro-machining in response to an electrostatic force generated by an applied voltage. The variable capacitor may also be of a type which varies the capacitance by inserting a dielectric or the like between a pair of opposing electrodes based on an electrostatic force generated by an applied voltage. Hence, a change in the reactance of the variable capacitor with respect to the applied voltage can thus be maintained linear in a relatively wide range. On the other hand, the inductance may be changed by controlling a length of a coil which is formed by micro-machining, controlling insertion of a magnetic material or the like with respect to the coil, based on an electrostatic force generated by an applied voltage. It is also possible to switch the capacitor and the inductance which are formed by the micro-machining, by turning a switch ON or OFF in response to the applied voltage. In this case, it is possible to control the reactance in steps.

Figure 5:
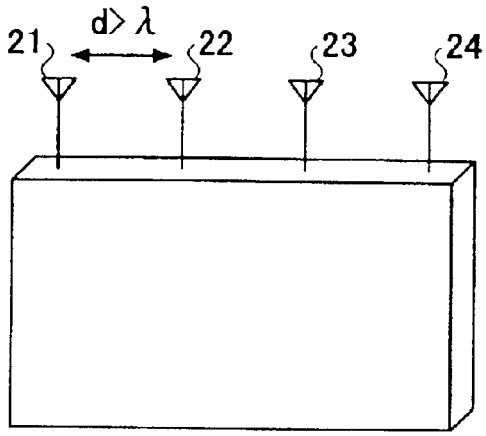
FIG. 5 is a diagram for explaining a first arrangement of antenna elements.
Figure 6:
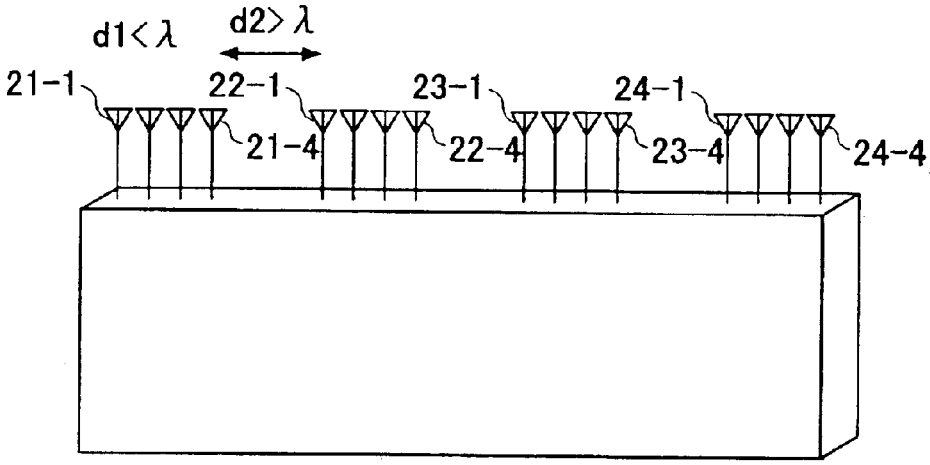
FIG. 6 is a diagram for explaining a second arrangement of antenna elements.
Figure 7:
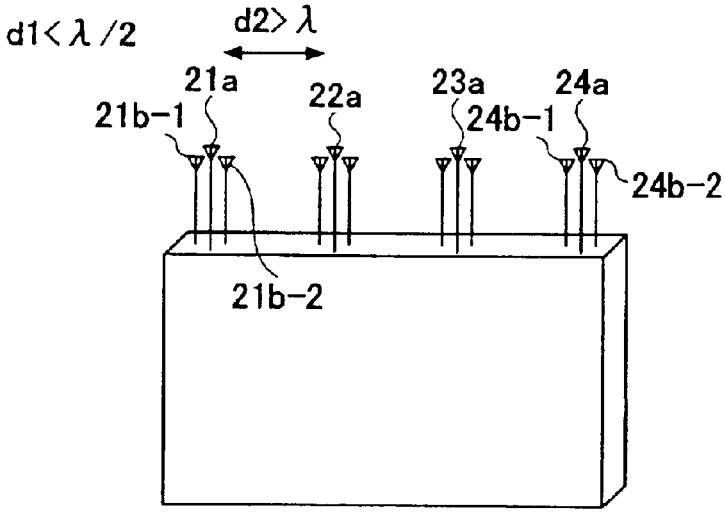
FIG. 7 is a diagram for explaining an embodiment of an arrangement of antenna elements.

FIGS. 5 through 7 are diagrams for explaining the arrangement of antenna elements.

Figure 1:
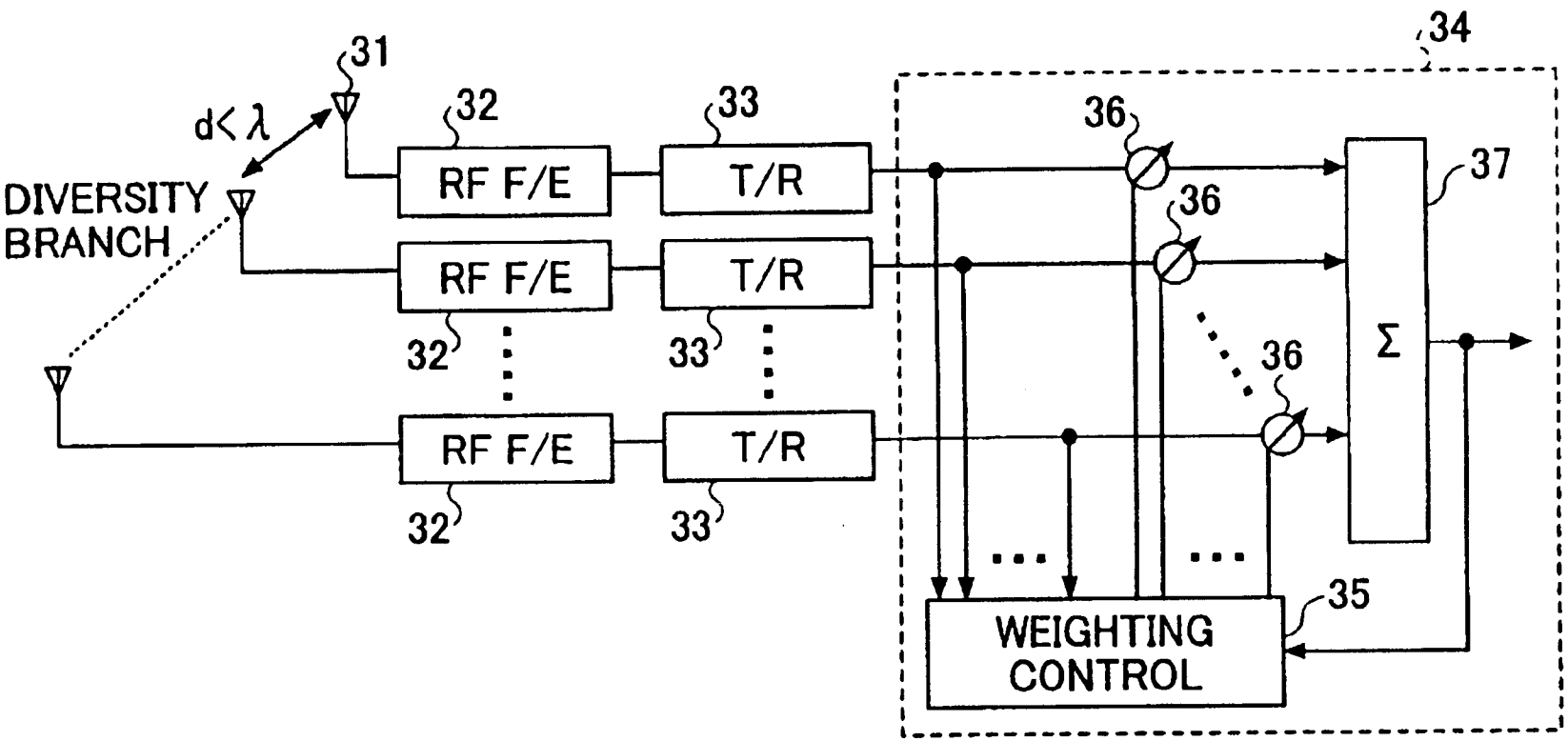
FIG.1 PRIOR ART
FIG. 1 is a diagram showing an example of such a conventional diversity antenna unit.
Figure 2:
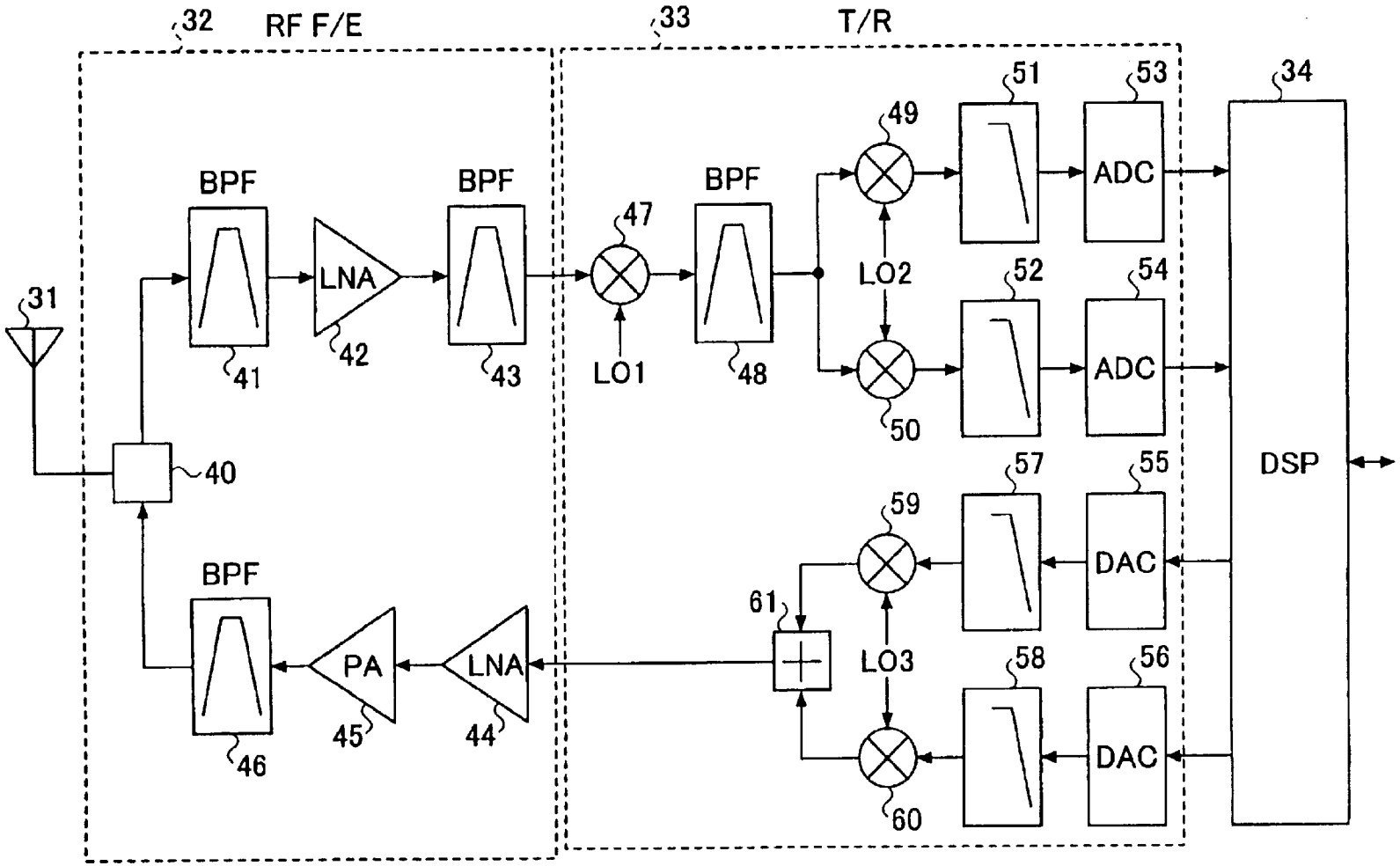
FIG.2 PRIOR ART
FIG. 2 is a diagram for explaining a transmitter-receiver circuit corresponding to one antenna element.

FIG. 5 shows a first arrangement of antenna elements applicable to the antenna elements 31 shown in FIG. 1. In FIG. 5, four antenna elements 21 through 24 are arranged at a pitch d satisfying a relationship d>λ, where λ denotes the wavelength, so as to form a diversity branch structure.

Figure 3:
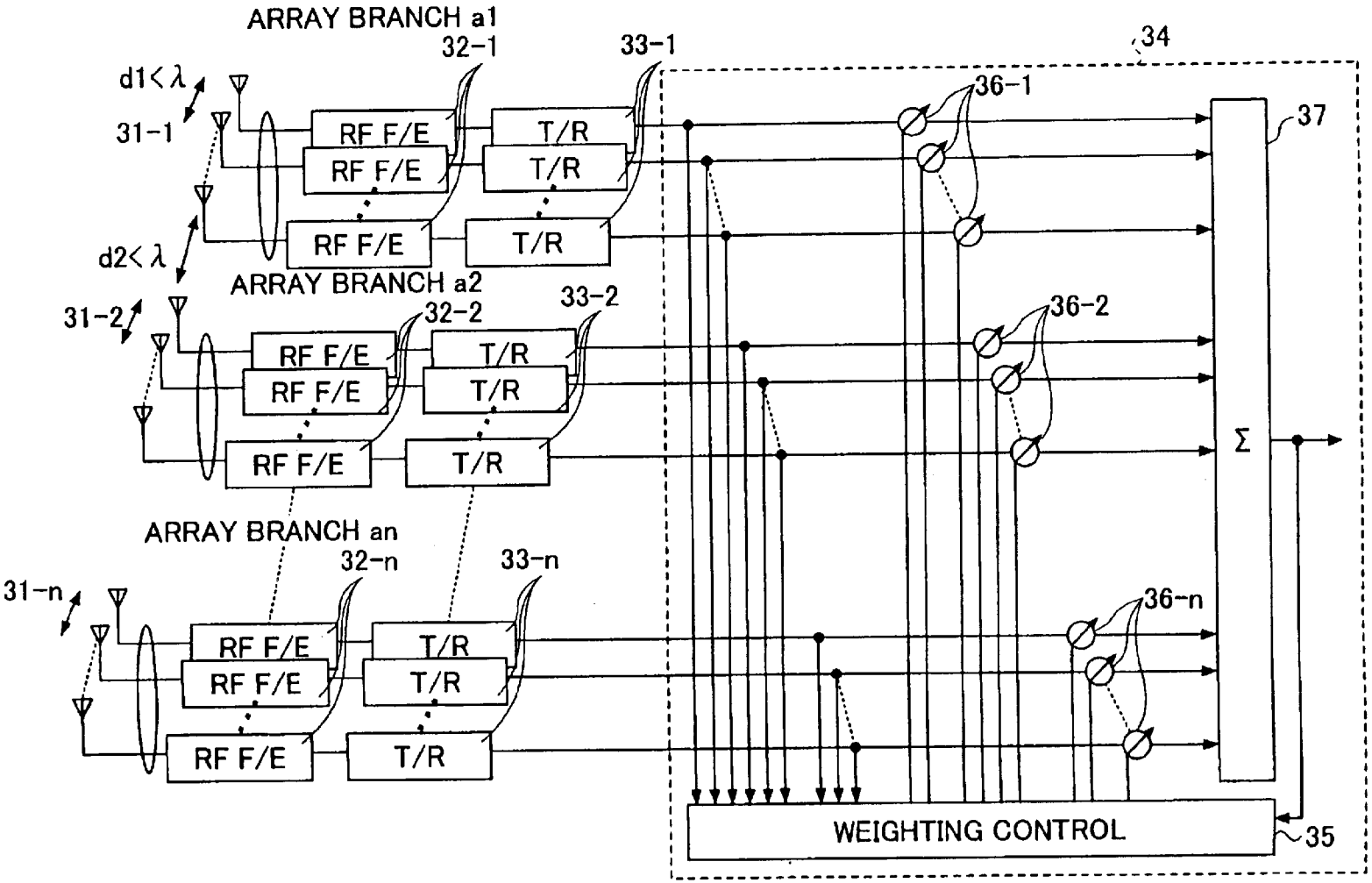
FIG.3 PRIOR ART
FIG. 3 is a diagram showing a proposed antenna unit having a structure which combines diversity branches and array branches.

FIG. 6 shows a second arrangement of antenna elements applicable to the antenna elements 31-1 through **31-*n* shown in FIG. 3. In FIG. 6, four antenna elements 21-1 through 21-4 are arranged at a pitch d1 satisfying a relationship d1<λ, where λ denotes the wavelength, so as to form a diversity branch structure. In addition, four antenna elements 22-1 through 22-4 are arranged at a pitch d1 satisfying a relationship d1<λ, where λ denotes the wavelength, so as to form a diversity branch structure. Moreover, four antenna elements 23-1 through 23-41 are arranged at a pitch d1 satisfying a relationship d1<λ, where λ denotes the wavelength, so as to form a diversity branch structure. Further, four antenna elements 24-1 through 24-4 are arranged at a pitch d1 satisfying a relationship d1<λ, where λ denotes the wavelength, so as to form a diversity branch structure. In addition, the four diversity branch structures are arranged at a pitch d2 satisfying a relationship d2**>λ, where λ denotes the wavelength.

FIG. 7 shows an embodiment of an arrangement of antenna elements applicable to this embodiment of the adaptive antenna unit shown in FIG. 4. In FIG. 7, four feeding antenna elements **21*a* through 24*a* are provided. Two parasitic antenna elements 21*b*-1 and 21*b*-2 are provided with respect to the feeding antenna element 21*a* to form one array branch structure, two parasitic antenna elements 22*b*-1 and 22*b*-2 are provided with respect to the feeding antenna element 22*a* to form one array branch structure, two parasitic antenna elements 23*b*-1 and 23*b*-2 are provided with respect to the feeding antenna element 23*a* to form one array branch structure, and two parasitic antenna elements 24*b*-1 and 24*b*-2 are provided with respect to the feeding antenna element 24*a* to form one array branch structure. Within each array branch structure, the two parasitic antenna elements are arranged at a pitch d1 satisfying a relationship d1<λ/2, where λ denotes the wavelength. Furthermore, the four array branch structures are arranged at a pitch d2 satisfying a relationship d2**>λ, where λ denotes the wavelength, so as to form a diversity branch structure.

The antenna elements may be arranged similarly to the arrangement shown in FIG. 7 when three or more parasitic antenna elements are arranged about each of the feeding antenna elements **21*a* through 24*a*.**

According to the embodiment of the arrangement shown in FIG. 7, it is possible to reduce the size of the structure compared to that shown in FIG. 6. In addition, in the 5 GHz band, the half-wave length becomes several cm, and it is difficult to apply the structure shown in FIG. 6 to the antenna unit of mobile terminals which are used for mobile communications. But according to the structure shown in FIG. 7, it is possible to realize a compact adaptive antenna unit which can be applied to the antenna unit of the mobile terminals such as portable telephone sets and data communication equipments. Moreover, according to the embodiment, the RFF/E, the transmitter-receiver and the like do not need to be provided with respect to each of the plurality of parasitic antenna elements, thereby making it possible to reduce the power consumption. Hence, the structure shown in FIG. 7 is suited to application to the mobile terminals also from the point of view of the reduced power consumption.

Patterns of each of the plurality of parasitic antenna elements 1*b*-1 through 1*b-n* may be printed on a film using a printed circuit technology. This film having the patterns of the parasitic antenna elements 1*b-i* printed thereon may be bent in a cylindrical shape, and a feeding antenna element 1*a-i* may be arranged along at a center axis of this cylindrical shape, so as to form an array branch 1*bi*. In this case, a dielectric may fill a space between the cylindrical shaped film and the and the feeding antenna element 1*a-i,* so as to reinforce the structure.

It is also possible to provide a feeding antenna element 1*a-i* at a center portion of a cylindrical dielectric body, and to form the plurality of parasitic antenna elements 1*b-i* on an outer peripheral surface of the cylindrical dielectric body using the printed circuit technique, so as to form the array branch 1*bi*. In this case, the dielectric body may have a polygonal shape or a columnar shape in correspondence with the number of parasitic antenna elements.

Further, a coaxial cable structure having a central conductor, an outer conductor, and a dielectric disposed between the central and outer conductors may be used for the antenna elements. In this case, the outer conductor may be patterned to form the patterns of the parasitic antenna elements 1*b*-1 through 1*b-n,* and the coaxial cable structure may be cut into predetermined lengths so as to form the array branches ab1 through abn. In this case, the array branches ab1 through 1*bn* have a cylindrical shape, and are arranged at the pitch d2 satisfying the relationship d2>λ, where λ denotes the wavelength. Such array branches ab1 through 1*bn,* each formed by the feeding antenna element and the parasitic antenna elements, and forming a monopole antenna, are arranged on a printed circuit substrate with the arrangement shown in FIG. 7.

The mobile terminal often moves while in use. Hence, the control of the weighting circuits 6-1 through 6-*n* and the control of the variable reactance elements 10-1 through 10-*n* by the reactance control circuits 8-1 through 8-*n* are adaptively controlled as the mobile terminal moves. Hence, based on intermittent common channel reception or the like in a standby state at the time when no communication is made, the control states by the weighting control circuit 5 and the reactance control circuits 8-1 through 8-*n* may be used as initial values for the time when the communication is started, so as to continue the adaptive control during the communication.

The weighting control circuit 5 controls the weighting with respect to the reception signals received by the corresponding feeding antenna elements 1*a*-1 through 1*a-n*, so as to maximize the SINR of the output of the combining circuit 7. In other words, both the weighting control circuit 5 and the reactance control circuits 8-1 through 8-*n* receive the reception signals received by the corresponding feeding antenna elements 1*a*-1 through 1*a-n*. For this reason, it is possible to construct the weighing control circuit 5 and the reactance control circuits 8-1 through 8-*n* so that control operations thereof are linked.

In the embodiment shown in FIG. 4, each reactance control circuit 8-*i* is provided in correspondence with the array branch abi, and controls the variable reactance elements 10-*i* of the array branch abi based on the reception signal received by the corresponding feeding antenna element 1*a-i*. However, in a modification of this embodiment, the reactance control circuits 8-1 through 8-*n* may be integrated into a single reactance control circuit which processes the mutual relationships of all of the reception signals received by the feeding antenna elements 1*a*-1 through 1*a-n*. In this case, the single reactance control circuit controls the variable reactance elements 10-1 through 10-*n* based on the processed mutual relationships so as to maximize the SIR of the reception signals received by the feeding antenna elements 1*a*-1 through 1*a-n*. Moreover, this single reactance control circuit will include a circuit portion which may be used in common with the weighting control circuit 5, and thus, this single reactance control circuit and the reactance control circuits 8-1 through 8-*n* may be integrated into a single reactance and weighting control circuit.

In the case of a communication employing the time division duplex (TDD), each antenna element may be shared for the transmission and reception, and the control states of the weighting control circuit 5 and the reactance control circuits 8-1 through 8-*n* at the time of the reception may be maintained and transmitted to a far end station such as a base station. In the case of a communication employing the frequency division duplex (FDD), each antenna element may be shared for the transmission and reception, but the transmission frequency and the reception frequency are different in this case. Hence, in this latter case, it is possible to provide an antenna structure for the transmission and an antenna structure for the reception, each having the plurality of array branches ab1 through abn described above.

According to the embodiment of the adaptive antenna unit described heretofore, it is possible to carry out compensation of the fading by the diversity branches formed by the feeding antenna elements 1*a*-1 through 1*a-n*. In addition, it is possible to suppress interference by forming array branches each formed by one feeding antenna element 1*a-i* and the corresponding parasitic antenna elements 1*b-i*. The adaptive antenna unit also has reduced size and power consumption due to the relatively simple structure, because a plurality of RFF/Es, transmitter-receivers, ADCs and the like can be omitted by terminating the parasitic antenna elements 1*b-i* which form the array branch by the corresponding variable reactance elements 10-*i*. Thus, the application of the adaptive antenna unit is not limited to a base station of a mobile communication system, and the adaptive antenna unit can similarly be applied to a terminal equipment.

In the embodiment of the adaptive antenna unit shown in FIG. 4, the feeding antenna element and the parasitic antenna elements are used to form a so-called space combining type array antenna for each array branch. Hence, the number of control targets, namely, the variable reactance elements, is small, thereby making the adaptive antenna element suited for use in compact mobile communication terminal equipments. However, the present invention is of course not limited to the above described embodiment, and the present invention may also utilize other array antennas such as a so-called RF processing type array antenna.

Figure 8:
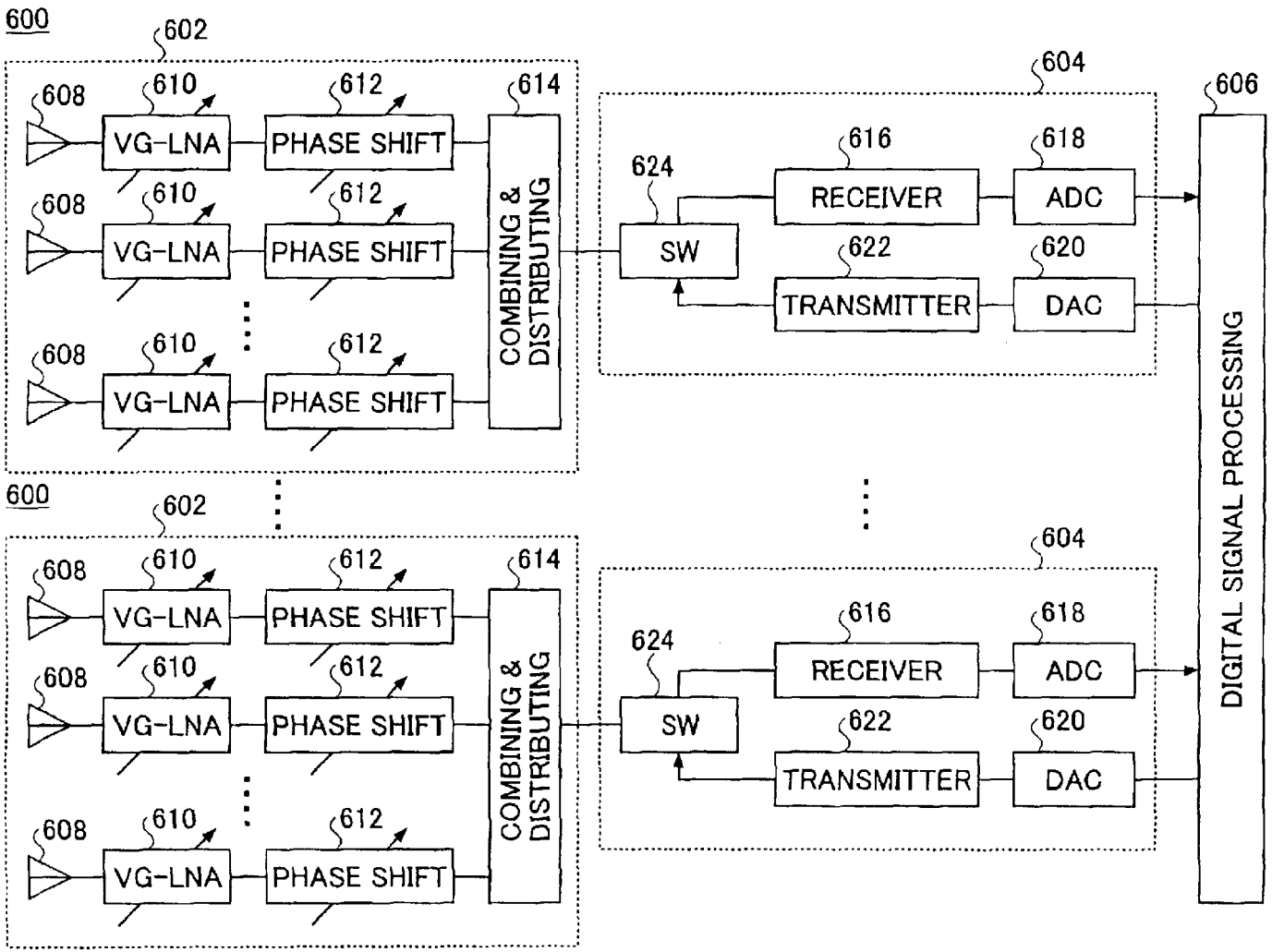
FIG. 8 is a diagram showing another embodiment of the adaptive antenna unit according to the present invention.

FIG. 8 is a diagram showing another embodiment of the adaptive antenna unit according to the present invention utilizing a phased array antenna which is one type of RF processing type array antenna. An adaptive antenna unit 600 shown in FIG. 8 generally includes a plurality of array antenna sections 602, a plurality of radio sections 604 each connected to a corresponding one of the array antenna sections 602, and a digital signal processing circuit 606 which is connected to the plurality of radio sections 604. Each array antenna section 602 and the corresponding radio section 604 connected thereto form one array branch. The radio section 604 corresponds to the RFF/E 2-*i* and the transmitter-receiver 3-*i* shown in FIG. 4. Two mutually adjacent array antenna sections 602 are provided with a sufficiently large separation (distance or pitch) so that the mutual spatial correlation is sufficiently small. For example, the distance between the two mutually adjacent array antenna sections 602 may be greater than or equal to the wavelength of the radio signals used for the communication.

Each array antenna section 602 includes a plurality of feeding antenna elements 608. Two mutually adjacent feeding antenna elements 608 are provided with a sufficiently small separation (distance or pitch) so that the mutual spatial correlation is sufficiently large. For example, the distance between two mutually adjacent feeding antenna elements 608 may be less than or equal to one-half the wavelength of the radio signals used for the communication. The array antenna section 602 includes a plurality of variable gain amplifiers 610 which are connected to the corresponding feeding antenna elements 608. For example, each variable gain amplifier 610 is formed by a variable gain low-noise amplifier (VG-LNA), and adjusts the signal amplitude. The array antenna section 602 also includes a plurality of phase shift circuits 612 which are connected to the corresponding variable gain amplifiers 610. For example, each phase shift circuit 612 is formed by a capacitor and/or a coil, and adjusts the phase of the input signals.

In FIG. 8, the phase shift circuit 612 is provided at a stage subsequent to the variable gain amplifier 610, but the order of the connection is not limited to that shown in FIG. 8. In other words, it is not essential for the phase shift circuit 612 to be provided at the stage subsequent to the variable gain amplifier 610, and the phase shift circuit 612 may be provided at the stage preceding the variable gain amplifier 610. This is because, what is required is that the amplitude and the phase of the reception signal received by (or the transmitting signal to be transmitted from) the feeding antenna element 608 are varied depending on a control signal which will be described later.

The array antenna section 602 further includes a combining and distributing circuit 614 which is connected to the plurality of phase shift circuits 612. The combining and distributing circuit 614 functions as a combining circuit which combines a plurality of signal into one signal at the time of the reception, and functions as a distributing circuit which distributes one signal into a plurality of signals at the time of the transmission.

Each radio section 604 includes a receiver 616 which carries out an RFF/E process, a frequency conversion and the like with respect to the reception signal, and an analog-to-digital converter (ADC) 618 which converts an analog output signal of the receiver 616 into a ditial signal and outputs the digital signal to the digital signal processing circuit 606 which is provided at the subsequent stge. Each radio section 604 also includes a digital-to-analog converter (DAC) 620 which converts a digital transmitting signal from the digital signal processing circuit 606 into an analog transmitting signal, and a transmitter which carries out an RFF/E process, a frequency conversion and the like with respect to the analog transmitting signal output from the DAC 620. Furthermore, each radio section 604 includes a switch 624 which switches between the transmission path and the reception path in time division so as to connect to the corresponding array antenna section 602.

The digital signal processing circuit 606 shown in FIG. 8 has a structure and functions which are basically the same as those of the digital signal processing circuit 4 shown in FIG. 4. But in this embodiment, the digital signal processing circuit 606 shown in FIG. 8 is provided with a controller for adjusting the amplitude and the phase of the signals at the variable gain amplifiers 610 and the phase shift circuits 612, in place of the reactance control circuits 8-1 through 8-*n*. This controller generates control signals indicative of the adjusting contents.

Next, a description will be given of the operation of this embodiment. First, at the time of the reception, the radio signals are received by the plurality of feeding antenna elements 608 of each of the array antenna sections 602. Each of the plurality of reception signals received by the plurality of feeding antenna elements 608 is appropriately weighted by the variable gain amplifier 610 and the phase shift circuit 612 of the corresponding signal path, and input to the combining and distributing circuit 614. In other words, the relative amplitude and phase of the plurality of reception signals are appropriately adjusted by the weighting. The combining and distributing circuit 614 combines the plurality of weighted reception signals, and outputs a signal for the array antenna section 602 to which the combining and distributing circuit 614 belongs. The output signal of the combining and distributing circuit 614, that is, the array antenna section 602, is input to the corresponding radio section 604, and the operation carried out thereafter is basically the same as that of the adaptive antenna unit described above in conjunction with FIG. 4. However, as described above, the controller is provided in place of the reactance control circuits 8-1 through 8-*n* of the digital signal processing circuit 4 shown in FIG. 4. Hence, the controller of the digital signal processing circuit 606 generates the control signals for adjusting the amplitude and the phase of the reception signals, so as to improve the signal quality (for example, the SIR, the SINR and the like) after the combining of the reception signals. The control signals generated from this controller are input to the variable gain amplifiers 610 and the phase shift circuits 612, and the amplitude and the phase of the reception signals are appropriately adjusted in the variable gain amplifiers 610 and the phase shift circuits 612 in response to the control signals.

At the time of the transmission, the transmitting signals generated by the digital signal processing circuit 606 are input to the corresponding array antenna sections 602 via the DAC 620, the transmitter 622 and the switch 624 of the corresponding radio sections 604. The transmitting signal input to the array antenna section 602 is distributed (or duplicated) into a number of signals corresponding to the number of feeding antenna elements 608 by the combining and distributing circuit 614. The phase and the amplitude of the signals from the combining and distributing circuit 614 are relatively adjusted by the phase shift circuits 612 and the variable gain amplifiers 610, and transmitted via the corresponding feeding antenna elements 608. The phase and the amplitude of the signals from the combining and distributing circuit 614 in this case are also controlled based on the control signals output from the controller within the digital signal processing circuit 606.

According to this embodiment of the adaptive antenna unit, the reception signals received by the feeding antenna elements 608 are combined by the combining and distributing circuit 614 while adjusting the amplitude and the phase thereof by the variable gain amplifiers 610 and the phase shift circuits 612, and each combined signal becomes a signal of a single diversity branch. In addition, the adaptive antenna unit supplies the transmitting signal for each diversity branch, and the transmitting signal is distributed by the combining and distributing circuit 614 into the number of signals corresponding to the number of feeding antenna elements 608, with the amplitude and phase of the distributed signals being adjusted prior to the transmission from the feeding antenna elements 608. Therefore, by making a diversity reception and/or transmission, the adaptive antenna unit can carry out a fading compensation. Furthermore, since the plurality of feeding antenna elements 608 within the array antenna section 602 are connected to the corresponding radio section 604 via the combining and distributing circuit 614, it is unnecessary to increase the number of radio sections 604 even when the number of feeding antenna elements 608 is increased. As a result, it is possible to suppress the increase in the size of the adaptive antenna unit when the number of feeding antenna elements 608 increases, and also reduce the power consumption. Moreover, since this embodiment can adjust the amplitude and the phase of the signals which are transmitted and received, the degree of freedom of signal adjustment is large, thereby making it suitable for further increasing the signal quality and the signal accuracy, for example.

In this embodiment, the variable gain amplifier 610 and the phase shift circuit 612 are provided with respect to each of the feeding antenna elements 608. This arrangement is preferable from the point of view of making the degree of freedom of signal adjustment large for the signal received by or to be transmitted from each of the feeding antenna elements 608. However, from the point of view of adjusting the relative amplitude and phase of the signals, it is possible to omit the variable gain amplifier 610 and the phase shift circuit 612 with respect to one feeding antenna element 608 within the array antenna section 602, for example. In addition, depending on the communication environment, a sufficiently high signal quality may be obtainable even without the amplitude adjustment. In such a case, the variable gain amplifier 610 may of course be omitted.

Figure 9:
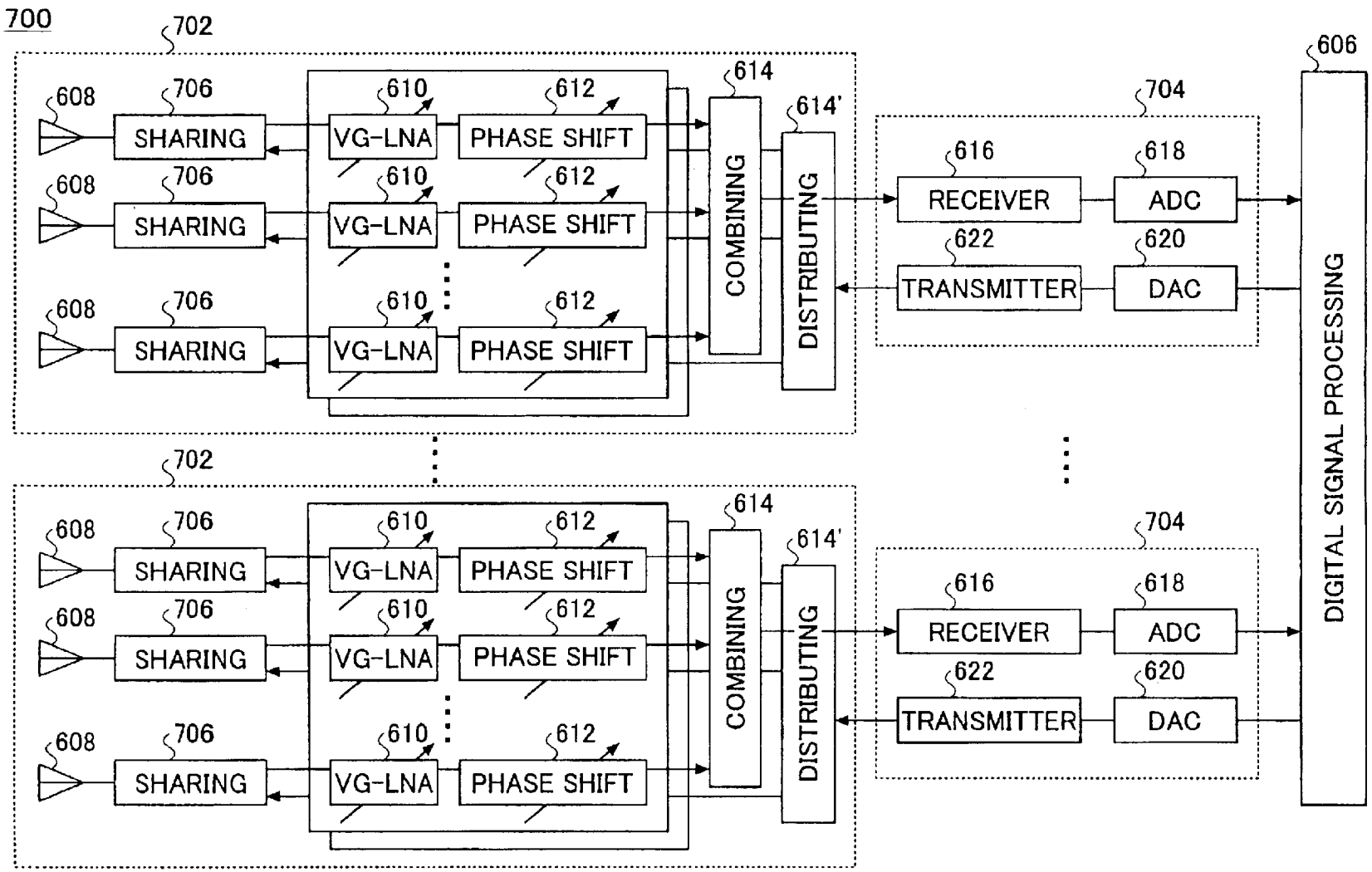
FIG. 9 is a diagram showing still another embodiment of the adaptive antenna unit according to the present invention.

FIG. 9 is a diagram showing still another embodiment of the adaptive antenna unit according to the present invention utilizing the phased array antenna which is one type of RF processing type array antenna. In FIG. 9, those parts which are the same as those corresponding parts in FIG. 8 are designated by the same reference numerals, and a description thereof will be omitted. An adaptive antenna unit 700 shown in FIG. 9 generally includes a plurality of array antenna sections 702, a plurality of radio sections 704 each connected to a corresponding one of the array antenna sections 702, and a digital signal processing circuit 606 which is connected to the plurality of radio sections 704.

Each array antenna section 702 includes a plurality of feeding antenna elements 608, and a frequency sharing unit 706 is provided with respect to each of the plurality of feeding antenna elements 608. The frequency sharing unit 706 has a filter function to enable sharing of a single antenna element 608 with respect to a certain frequency band (for example, the band of the reception signal) and another frequency band (for example, the band of the transmitting signal). By providing the frequency sharing unit 706 with respect to the feeding antenna element 608, the feeding antenna element 608 can simultaneously transmit and receive signals, as long as the signal frequencies appropriately differ.

The array antenna section 702 shown in FIG. 9 includes a variable gain amplifier 610 and a phase shift circuit 612 respectively for the reception signal, with respect to each feeding antenna element 608. Furthermore, the array antenna section 702 includes a combining circuit 614 which is connected to the plurality of phase shift circuits 612. The array antenna section 702 also includes a distributing circuit 614', phase shift circuits and variable gain amplifiers with respect to the transmitting signals, but the illustration of the phase shift circuits and the variable gain amplifiers is omitted in FIG. 9 so as to simplify the drawing.

Each radio section 704 includes a receiver 616 which is connected to an output of the combining circuit 614 of the corresponding array antenna section 702, and an analog-to-digital converter (ADC) 618 which is connected between an output of the receiver 616 and an input of the digital signal processing circuit 606. Each radio section 704 also includes a digital-to-analog converter (DAC) 620 which is connected to an output of the digital signal processing circuit 606, and a transmitter 622 which is connected between an output of the DAC 620 and an input of the distributing circuit 614' of the corresponding array antenna section 702.

According to this embodiment shown in FIG. 9, the transmission path and the reception path are always connected to the feeding antenna elements 608, unlike the embodiment shown in FIG. 8 in which the transmission path or the reception path is selectively connected to the feeding antenna elements 608. The present invention can thus be applied not only to the TDD, but also to the FDD. According to the FDD, the communication terminal equipment can transmit and receive at the same time. Hence, as shown in FIG. 9, the variable gain amplifiers 610, the phase shift circuits 612 and the combining circuit 614 are provided exclusively for the reception path, and the distributing circuit 614', the phase shift circuits (not shown) and the variable gain amplifiers (not shown) are provided exclusively for the transmission path.

In the embodiment shown in FIG. 9, all of the feeding antenna elements 608 within the array antenna section 702 are shared for the transmission and reception by the provision of the same number of frequency sharing units 706. This arrangement which provides the same processing capability for the transmission and reception is preferable from the point of view of making the bi-directional communication with approximately the same signal quality. However, the present invention is of course not limited to this arrangement, and the array antenna section 702 may be constructed so that only a portion of the plurality of feeding antenna elements 608 are shared for the transmission and reception.

Figure 10:
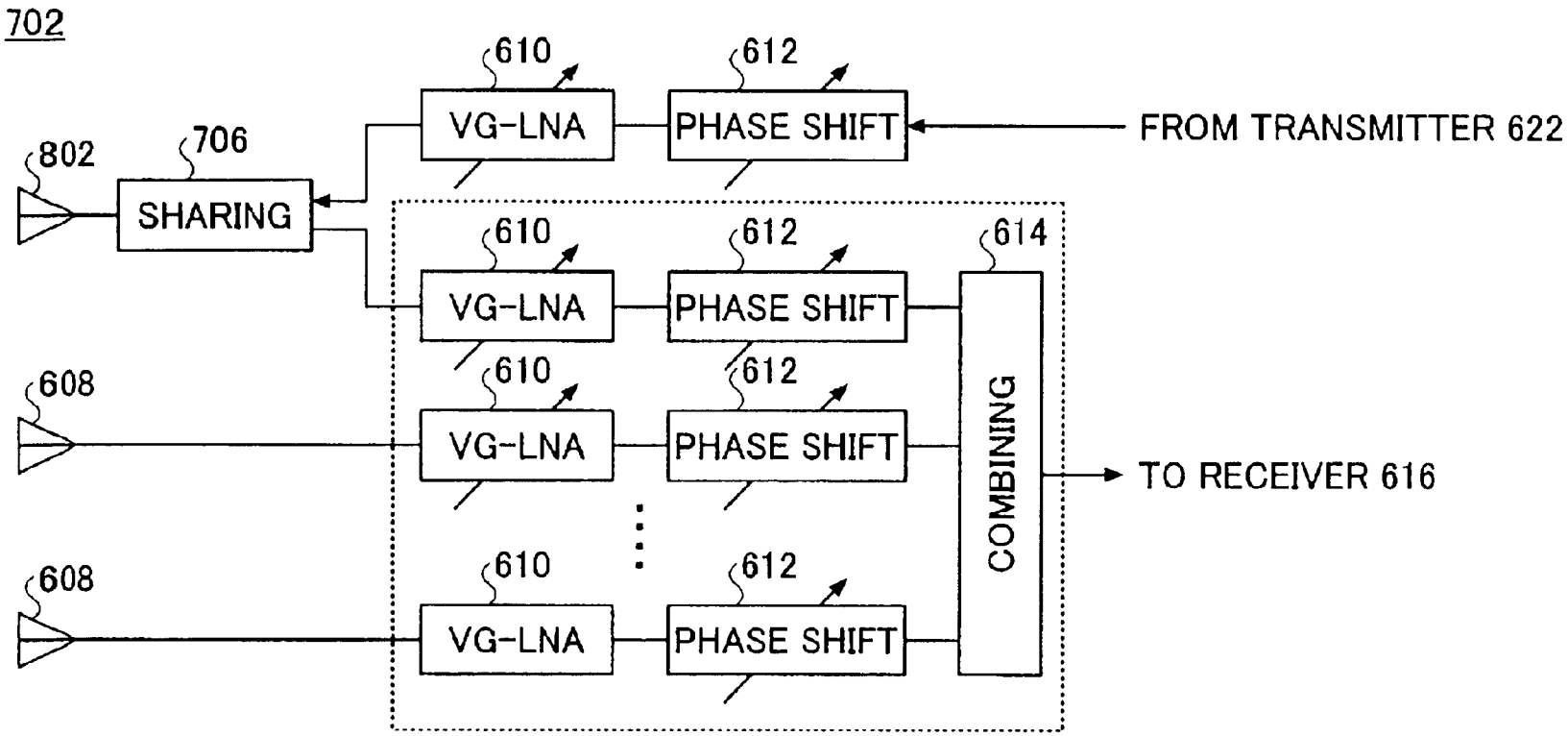
FIG. 10 is a diagram showing a modification of an array antenna section.

FIG. 10 is a diagram showing a modification of the array antenna section. In FIG. 10, those parts which are the same as those corresponding parts in FIG. 9 are designated by the same reference numerals, and a description thereof will be omitted. In this modification, a feeding antenna element 802 is shared for the transmission and reception by the provision of a frequency sharing unit 706, but the other feeding antenna elements 608 are used exclusively for the reception. This arrangement is preferable particularly in a case where a higher signal quality is required for the communication on a down-channel than on an up-channel. For example, a communication terminal equipment may send a simple instruction to download a file on the up-channel by a diversity transmission, and download the file containing considerable amount of high-quality information on the down-channel by making the diversity reception using the adaptive array antenna.

Although the structure of the transmission path is simplified in FIG. 10, it is of course possible to simplify the structure of the reception path.

Therefore, it is possible to provide the communication capacity and/or functions by taking into consideration the asymmetry of the up-channel and the down-channel of the communication system, thereby enabling the reduction in the size and power consumption of the communication terminal equipment to suit the communication system.

An embodiment of a terminal equipment according to the present invention is provided with a known transmitting and receiving means for making a communication, and any of the embodiments of the adaptive antenna unit described above. The terminal equipment may be any type of terminal capable of making a communication, such as a portable telephone set, a data communication equipment and a base station of a mobile communication system.

Further, the present invention is not limited to these embodiments, but various variations and modifications may be made without departing from the scope of the present invention.

I claim:

1. An adaptive antenna unit comprising:

a plurality of feeding antenna elements arranged so as to reduce spatial correlations thereof;

a plurality of parasitic antenna elements, provided with respect to each of the plurality of feeding antenna elements, and arranged so as to increase mutual coupling between a corresponding one of the plurality of feeding antenna elements;

a plurality of variable reactance elements, each terminating a corresponding one of the plurality of parasitic antenna elements; and a control section controlling reactances of the plurality of reactance elements and controlling weighting of the reception signals received by the plurality of feeding antenna elements, in response to the reception signals, said weighting of the reception signals including weighting phases or, the phases and amplitudes of the reception signals.

2. The adaptive antenna unit as claimed in claim 1, wherein said control section comprises:

a reactance control circuit controlling the reactances of the plurality of variable reactance elements in response to the reception signals;

a weighting circuit weighting the reception signals and outputting weighted reception signals;

a weighting control circuit controlling the weighting of the weighting circuit in response to the reception signals; and a combining circuit combining the weighted reception signals.

3. The adaptive antenna unit as claimed in claim 2, wherein said weighting control circuit controls the weighting of the weighting circuit, so as to maximize a signal-to-interference-plus-noise ratio (SINR) of an output signal of the combining circuit.

4. The adaptive antenna unit as claimed in claim 2, wherein said reactance control circuit controls the reactances of the variable reactance elements based on the reception signal received by the plurality of feeding antenna elements, so as to maximize a signal-to-interference ratio (SIR) of the reception signals received by the plurality of feeding antenna elements.

5. The adaptive antenna unit as claimed in claim 1, wherein:

each of the plurality of feeding antenna elements and corresponding parasitic antenna elements form an array branch;

the plurality of parasitic antenna elements are arranged at a pitch d1 satisfying a relationship $d1<\lambda/2$, where $\lambda$ denotes a wavelength; and a plurality of array branches are arranged at a pitch d2 satisfying a relationship $d2>\lambda$.

6. The adaptive antenna unit as claimed in claim 5, wherein each of the array branches comprises:

a single radio frequency front end coupled to a corresponding one of the plurality of feeding antenna elements; and a single transmitter-receiver receiving an output of the single radio frequency front end.

7. The adaptive antenna unit as claimed in claim 5, wherein said control section comprises:

a reactance control circuit controlling the reactances of the plurality of variable reactance elements within each of the plurality of array branches in response to a corresponding one of the reception signals;

a weighting circuit weighting the reception signals and outputting weighted reception signals;

a weighting control circuit controlling the weighting of the weighting circuit in response to the reception signals; and a combining circuit combining the weighted reception signals.

8. The adaptive antenna unit as claimed in claim 7, wherein said weighting control circuit controls the weighting of the weighting circuit, so as to maximize a signal-to-interference-plus-noise ratio (SINR) of an output signal of the combining circuit.

9. The adaptive antenna unit as claimed in claim 7, wherein said reactance control circuit controls the reactances of the variable reactance elements within each of the plurality of array branches based on a corresponding one of the reception signals received by the plurality of feeding antenna elements, so as to maximize a signal-to-interference ratio (SIR) of the reception signals received by the plurality of feeding antenna elements.

10. A terminal equipment comprising:

an adaptive antenna unit; and transmitting and receiving means for making a communication via the adaptive antenna unit, said adaptive antenna unit comprising:

a plurality of feeding antenna elements arranged so as to reduce spatial correlations thereof;

a plurality of parasitic antenna elements, provided with respect to each of the plurality of feeding antenna elements, and arranged so as to increase mutual coupling between a corresponding one of the plurality of feeding antenna elements;

a plurality of variable reactance elements, each terminating a corresponding one of the plurality of parasitic antenna elements; and a control section controlling reactances of the plurality of reactance elements and controlling weighting of the reception signals received by the plurality of feeding antenna elements, in response to the reception signals, said weighting of the reception signals including weighting phases or, the phases and amplitudes of the reception signals.

11. An adaptive antenna unit comprising:

a plurality of array antenna sections provided at a pitch greater than a predetermined distance;

a weighting control section weighting and combining output signals of the plurality of array antenna sections; and a controller generating control signals based on the output signals of the plurality of array antenna sections, wherein each of the plurality of array antenna sections comprises:

a plurality of antenna elements arranged at a pitch smaller than the predetermined distance;

a phase shift part to adjust relative phases of reception signals received by the plurality of antenna elements in response to the control signals; and a combining circuit to combine the reception signals obtained via the phase shift section, in analog form, and to output an analog output signal to a receiver/transmitter section.

12. The adaptive antenna unit as claimed in claim 11, wherein said phase shift part is provided with respect to all or a portion of the plurality of antenna elements.

13. The adaptive antenna unit as claimed in claim 11, wherein each of said plurality of array antenna sections further comprises:

a variable gain amplifier part to adjust relative amplitudes of the reception signals received by the plurality of antenna elements in response to the control signals.

14. The adaptive antenna unit as claimed in claim 13, wherein said variable gain amplifier part is provided with respect to all or a portion of the plurality of antenna elements.

15. The adaptive antenna unit as claimed in claim 11, further comprising:

a switch part to switch and use the plurality of antenna elements in time division between a time of transmission and a time of reception.

16. The adaptive antenna unit as claimed in claim 11, wherein each of said array antenna section further comprises:

a frequency sharing unit to share a corresponding one of the plurality of antenna elements in a transmission frequency band and a reception frequency band, with respect to all or a portion of the plurality of antenna elements.

17. A terminal equipment comprising:

an adaptive antenna unit; and transmitting and receiving means for making a communication via the adaptive antenna unit, said adaptive antenna unit comprising:

a plurality of array antenna sections provided at a pitch greater than a predetermined distance;

a weighting control section weighting and combining output signals of the plurality of array antenna sections; and a controller generating control signals based on the output signals of the plurality of array antenna sections, wherein each of the plurality of array antenna sections comprises:

a plurality of antenna elements arranged at a pitch smaller than the predetermined distance;

a phase shift part to adjust relative phases of reception signals received by the plurality of antenna elements in response to the control signals; and a combining circuit to combine the reception signals obtained via the phase shift section, in analog form, and to output an analog output signal to the transmitting and receiving means.

18. An adaptive antenna unit comprising:

a plurality of array antenna sections provided at a pitch greater than a predetermined distance;

a weighting control section weighting and combining output signals of the plurality of array antenna sections at a time of reception and weighting and combining input signals to the plurality of array antenna sections at a time of transmission; and a controller generating control signals based on the output signals of the plurality of array antenna sections at the time of reception;

wherein each of the plurality of array antenna sections comprises:

a plurality of antenna elements arranged at a pitch smaller than the predetermined distance;

a phase shift part to adjust relative phases of reception signals received by the plurality of antenna elements in response to the control signals; and a combining and distributing circuit to combine the reception signals obtained via the phase shift section, in analog form, and to output an output analog signal to a receiver/transmitter section at the time of reception, and to distribute transmitting signals from the receiver/transmitter section, in analog form, to the plurality of antenna elements via the phase shift part at the time of transmission.

* * * * *